United States Patent [19]

Kleva

[11] 4,341,386

[45] Jul. 27, 1982

[54] GAME BOARD APPARATUS HAVING REMOVABLE PLAYING PIECE MOVEMENT AREAS

[76] Inventor: Jacob J. Kleva, 10 New York Ave., Cumberland, R.I. 02864

[21] Appl. No.: 169,201

[22] Filed: Jul. 15, 1980

[51] Int. Cl.[3] ..... A63F 3/00

[52] U.S. Cl. ..... 273/239; 273/248; 273/272; 273/284

[58] Field of Search ..... 273/243, 272, 282, 283, 273/284, 239, 248, 288

[56] References Cited

U.S. PATENT DOCUMENTS

| | | | |
|---|---|---|---|
| 1,339,013 | 5/1920 | Bennett | 273/284 X |
| 3,603,591 | 9/1971 | Shoptaugh | 273/284 X |
| 3,741,545 | 6/1973 | Weisbecker | 273/283 X |
| 3,847,397 | 11/1974 | Price | 273/283 |
| 3,860,242 | 1/1975 | Martin | 273/284 X |
| 4,071,245 | 1/1978 | Kendrick | 273/284 |

FOREIGN PATENT DOCUMENTS

| | | | |
|---|---|---|---|
| 594725 | 11/1947 | United Kingdom | 273/284 |

*Primary Examiner*—Anton O. Oechsle
*Attorney, Agent, or Firm*—Stevens, Davis, Miller & Mosher

[57] ABSTRACT

Disclosed is a game apparatus comprising a game board having a playing surface containing playing piece movement areas. At least some of the playing piece movement areas are in areas defined by channels into which are fit respective game pieces, each containing an upwardly directed face having an indicium thereon. The indicium for each of the game pieces can be letters of the alphabet, arithmetic numerals or other information, which can be formed into a plurality of indicia patterns, such as words, mathematical problems or an information sequence which can be assigned a player for him to traverse by movement of his playing piece among the playing piece movement areas. The playing piece movement areas on each game board section are grouped together by additional indicium provided on the game board sections to define groups of playing piece movement areas, a playing piece being required to traverse each of the movement areas in a group before proceeding to another group, thus establishing tortuous paths for playing pieces as they move on the playing surface through assigned indicia patterns. The game board can be formed as a plurality of game board sections which are removably engageable either with each other or with an optional crosspiece to permit reorientation of a portion of the game board before or during the play of a game.

26 Claims, 10 Drawing Figures

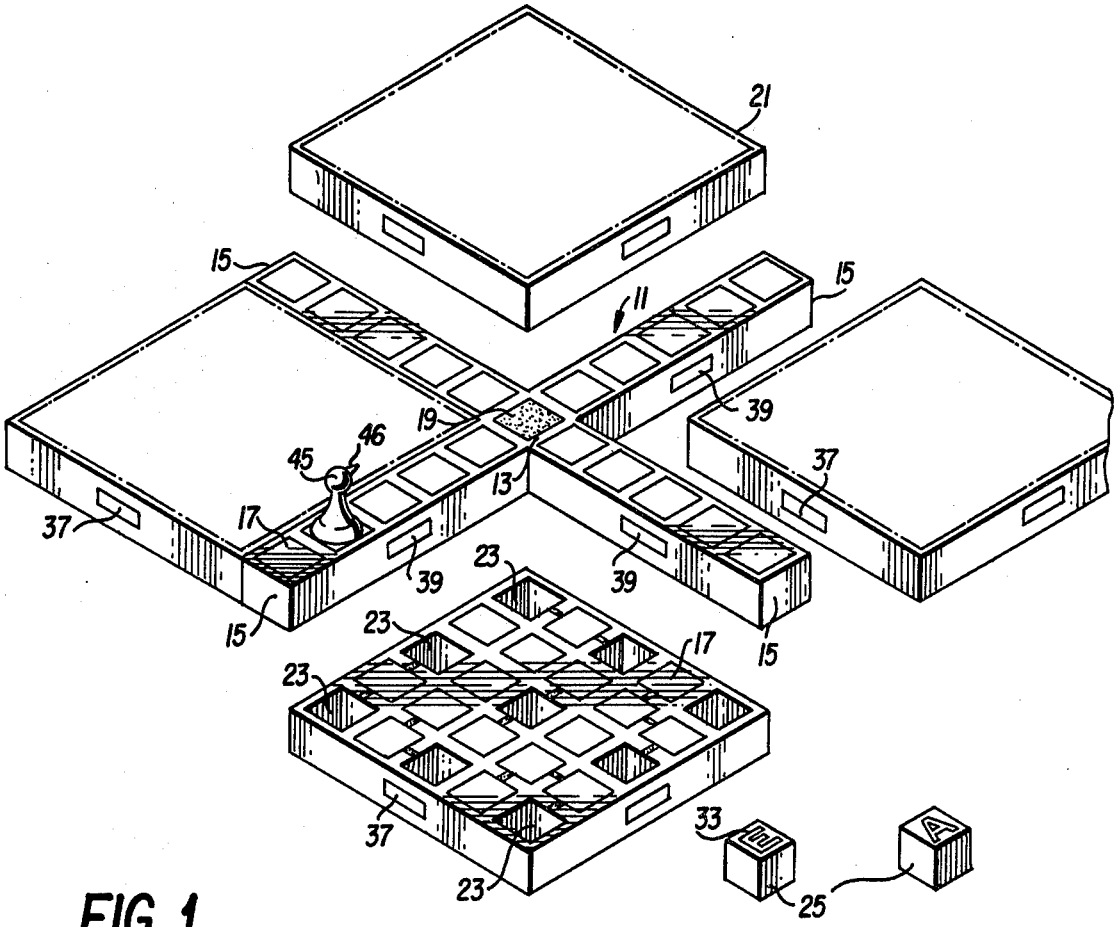
FIG. 1
FIG. 6
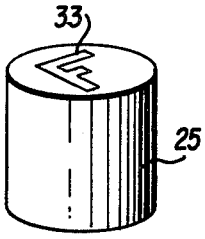
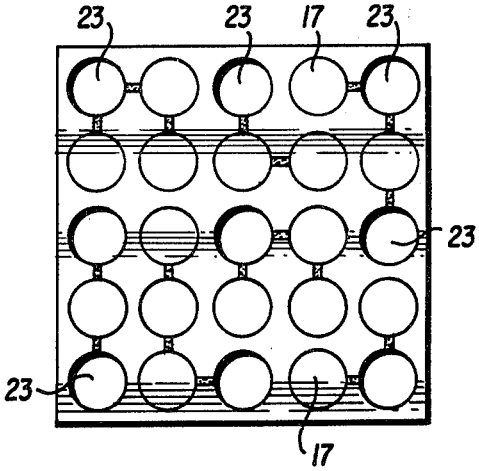
FIG. 5

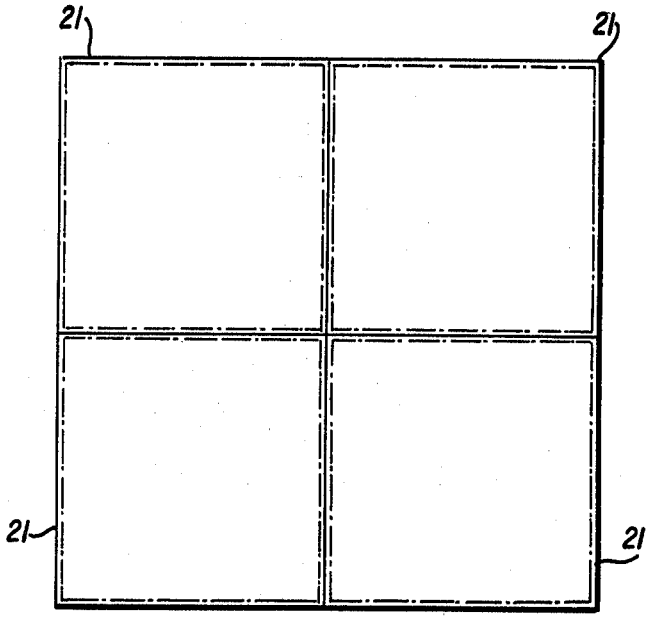
FIG. 7
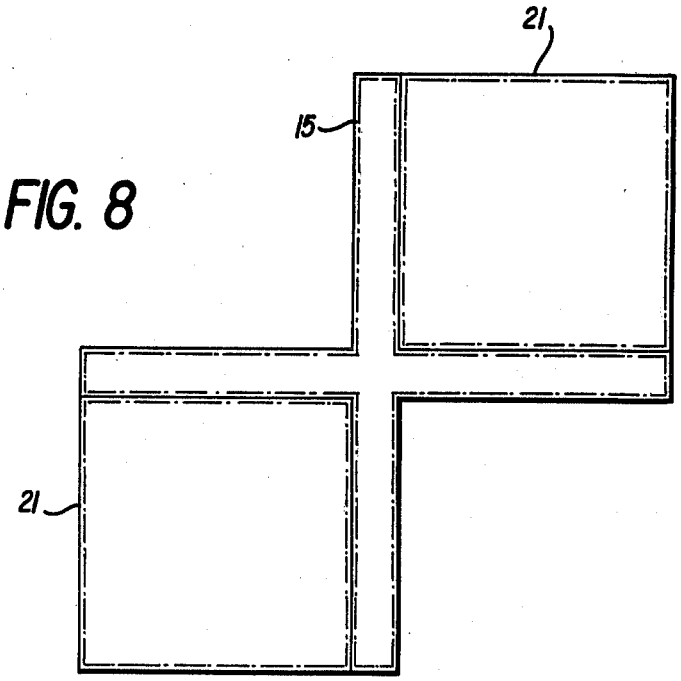
FIG. 8
FIG. 9
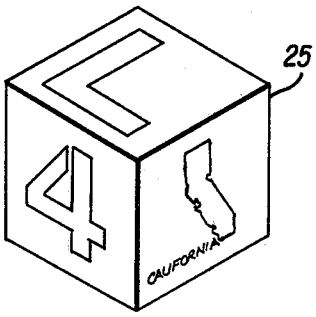
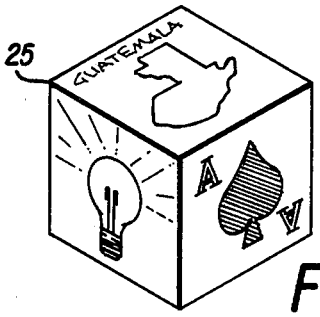
FIG. 10

GAME BOARD APPARATUS HAVING REMOVABLE PLAYING PIECE MOVEMENT AREAS

SUMMARY OF THE INVENTION

The present invention relates to games, particularly to an improved game apparatus providing a playing surface for a game which can be played by children to adults which requires the skills of concentration, fast thinking, reasoning, and luck. Because of the arrangement of the playing surface, anywhere from two to ten people can play. The game apparatus of the invention may be constructed in various arrangements and may be used for fun, education, and/or a combination of the two.

Basically, the game apparatus of the invention forms a game board having a plurality of playing piece movement areas on a top playing surface thereof. The playing piece movement areas are grouped by a plurality of first indicium provided on the playing surface into groups containing anywhere from 1 to 6 playing piece movement areas. The grouping of the playing piece movement areas is provided to increase difficulty of play, as a playing piece must traverse each movement area of a group before exiting that group and entering another. This provides a tortuous path which must be traversed by a playing piece to reach any particular destination on the board. The playing piece movement areas may be conveniently provided in rows and columns on the game playing surface.

Selected ones of the playing piece movement areas are in areas defined as channels into which are randomly inserted game pieces having respective alphabetic, numerical or other second indicium thereon. The second indicium can be formed into a plurality of patterns such as words, mathematical problems, or a sequence of information, to be executed by a player moving his playing piece among the playing piece movement areas of the playing surface. Each player must move over the playing surface to traverse each of the letters, numerals/symbols, or sequenced information in a pattern assigned him. The first player to traverse all movement areas containing all the second indicium for his assigned pattern is the winner.

The game board can be conveniently formed from a crosspiece having a central portion and arms radially extending therefrom containing on a top surface and extending along the arms a portion of the playing piece movement areas and four game sections which removably fit within adjacent arms of the crosspiece. Each of the game sections includes, on a top surface, the remaining portion of the playing piece movement areas which are grouped by the first indicia referred to above. By enabling the game sections to be removably fit with respect to arms of the crosspiece, one can rotate the game sections to provide different groupings of movement areas adjacent different arms of the crosspiece, thus permitting variations in the playing surface, which variations can be introduced during the course of a game, if desired. As an option, the crosspiece may be omitted and the playing surface formed by two or more juxtaposed game sections. Also, anywhere from two to four game sections can be used with the crosspiece.

Each of the game sections includes one or more of the above channels, each at a predetermined playing piece movement area, which can be filled with a game piece containing a second indicium such as a letter, number or other information, depending on whether a word, numerical problem, or information sequence game is desired. The game pieces are randomly inserted into the channels with the indicium for a chosen type of game, e.g. a word game, face up.

Commencing play, each player chooses, within a prescribed time, a word, numerical or other sequential information pattern for another player to traverse on the playing surface and communicates his choice to that player. In lieu of each player directly communicating his chosen pattern to another player, each pattern chosen by a player can be written on a piece of paper and all papers grouped together for random player selection of an assigned pattern.

It is also not necessary that the entire pattern be assigned a player at the commencement of play. Portions of a pattern can be provided during play. For example, if a word game is being played, a player assigned to traverse a predetermined word pattern may be provided the letters of the word one at a time, the succeeding letter of the word being provided only after a player assigned the word traverses a preceeding letter of the word.

Play can start at any place on the game board; however, if a cross piece is used, it is convenient to use the center portion of the crosspiece as a starting position from which all pieces move. The number of playing piece movement areas traversed in any given move by a player is determined by the throw of a pair of dice, the rotation of a spin dial, or by assigning each player a fixed number of moves for each turn. As mentioned above, in traversing the game board to spell his assigned word or traversing an assigned numerical or sequential information pattern, a player must, when in a group of movement areas, traverse every movement area of the group before proceeding to another group. In addition, a player can only enter or exit a particular group at a terminal movement area of the group; a player cannot enter or exit at an intermediate movement area of a group. In addition, only horizontal and vertical movements of a playing piece are permitted.

Predetermined ones of the movement areas on the playing surface also can contain messages instructing a player to take specific actions, e.g. to miss a turn, to take an additional turn, to turn one of the game board sections to any orientation desired, or to exchange his playing piece with that of any other player on the board. Thus, by landing on these message areas, a player may either be helped or hindered in his attempts to traverse the board to execute his assigned pattern.

If a crosspiece is used, the sides of the crosspiece and associated game sections can have engagement means in the form of magnets provided in the crosspiece sidewalls and opposing metallic plates provided in the sidewalls of the game sections to hold the game board together while permitting reorientation of a game section.

The above described features and others of the invention can be more fully appreciated from the following detailed description thereof which is provided in conjunction with the accompanying drawings in which:

FIG. 1 illustrates in perspective view one embodiment of the invention including a crosspiece, four game sections and representative game pieces;

FIG. 5 illustrates a modified game section which can be used in the invention;

FIG. 6 illustrates a modified game piece for use with the modified game section of FIG. 5;

FIG. 7 illustrates in perspective view another embodiment of the invention similar to that of FIG. 1, but omitting the crosspiece;

FIG. 8 illustrates in plan view another embodiment using the crosspiece and two game board sections;

FIG. 9 illustrates in perspective view three sides of a preferred game piece containing on six respective faces indicium for six different types of games; and FIG. 10 illustrates in perspective view the other three sides of the game piece of FIG. 9.

DETAILED DESCRIPTION OF THE INVENTION

Figure 2:
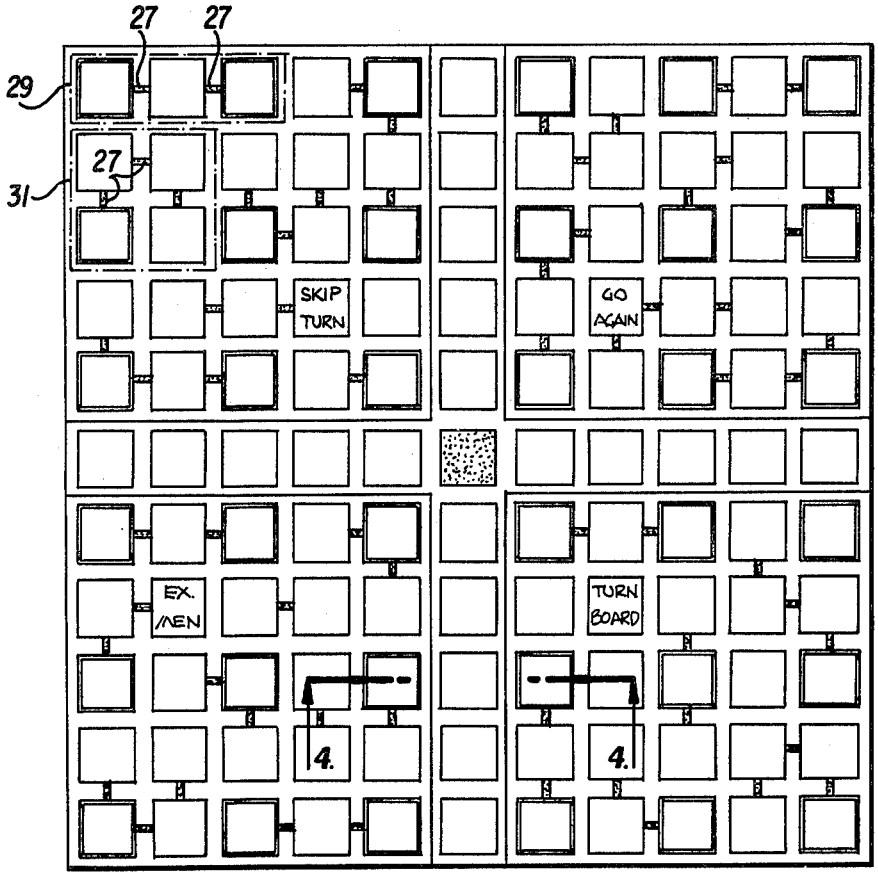
FIG. 2 illustrates a top plan view of the game apparatus of FIG. 1 in an assembled state.
Figure 3:
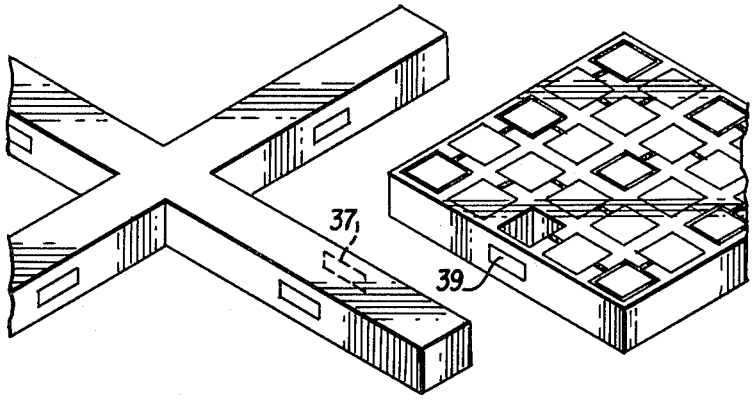
FIG. 3 illustrates in perspective view a portion of the apparatus of FIG. 1.
Figure 4:
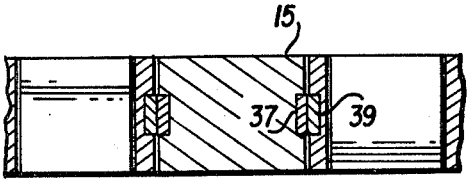
FIG. 4 illustrates a sectional view along the lines 4—4 of FIG. 2.

Referring to FIG. 1, a first embodiment of the game apparatus of the invention is shown as comprising a center crosspiece 11 having a central portion 13 from which a plurality of arms 15 emanate. The top surface of the crosspiece includes playing piece movement areas 17 extending along arms 15 among which a playing piece 45 can move. The playing piece 45 preferably includes a direction indicator 46 showing direction of movement. A plurality of game sections 21 are also provided which fit between respective pairs of arms 15 of the crosspiece 11. Four square game sections are shown in FIGS. 1 and 2.

Each of the game sections includes a plurality of playing piece movement areas 17 on a top surface, some of which include areas defined as channels 23 which extend through sections 21. The remaining, non-channel playing piece movement areas 17 are provided on the top surface of game board sections 21 like the playing piece movement areas on crosspiece 11. To simplify illustration, only the lowermost of the sections 21 is shown in detail in FIG. 1; however, it is to be understood that all of the sections 21 have the same general construction.

A plurality of game pieces 25 are provided, each having on an upper face 33 thereof an indicium. When the game apparatus of the invention is used to play word-forming games, that is to form word patterns, the game pieces 25 include alphabetic characters provided on the upper face 33. For numerical pattern games, the upper face 33 of respective game pieces may include numerals or arithmetic symbols, e.g., addition, multiplication, substraction, division, equals, etc. Additional game variations may be attained by using other indicium on upper face 33, such as playing card symbols, e.g. ace of spaces, king of diamonds, etc.; the names of states, the names of countries, or the names of inventions associated with certain inventors. FIGS. 9 and 10 illustrate a cubic game piece having these various indicia on respective faces permitting six different game variations; any one of the faces can be used as upper face 33.

Each of the game pieces 25 is adapted to fit into a channel 23 such that the upper indicium bearing face 33 thereof is substantially flush with the top surface of game section 21 thereby establishing, with the game sections 21 and crosspiece 11, a substantially flat playing surface upon which a playing piece may move among the playing piece movement areas 17. Pattern forming indicium may also be applied to the non-channel movement areas of the playing surface, if desired, as described in further detail below.

As illustrated in FIG. 2, the crosspiece 11 and four associated game sections 21 fit together to form a substantially solid square game playing surface. FIG. 2 also illustrates the playing surface formed when the game board pieces 25 are fit into the channels 23.

As further illustrated in FIGS. 1 and 2, each of the playing piece movement areas 17 in the game sections 21 are grouped together by a plurality of indicium 27 which link the playing piece movement areas forming groups of 1, 2, 3, 4, 5 or 6 movement areas. Two such groups are illustrated by dotted lines in FIG. 2 as 29 and 31. The plurality of indicium 27 can be provided in any manner desired to group various ones of the playing piece movement areas together, the purpose of this grouping being to make a playing piece move through each movement area of a group before exiting the group, as described above and in further detail below.

Each of the game sections 21 is readily removable from between adjacent arms 15 of crosspiece 11. In this manner, each game section can be removed, rotated and reinserted between any pair of arms of the crosspiece 11 to thereby change the playing surface and the relative location of the grouped playing piece movement areas of one game section relative to the remaining playing piece movement areas.

The playing surface, as illustrated in FIG. 2, also includes movement areas 17 containing player instruction messages such as skip turn, go again, turn board, and exchange men; the purpose of these instruction messages will be further described in detail below.

To retain the game board pieces 21 in a proper relative position with respect to adjacent arms 15 of the crosspiece 11, magnets 39 and metallic plates 37 can be provided respectively in the sidewalls of the crosspiece arms and opposing sidewall of the game sections. The magnets 39 and metallic plates 37 insure engagement of the crosspiece 11 with the game sections 21. This engagement can be readily broken to permit reorientation of a particular game section relative to the remaining game apparatus.

Preferably, the crosspiece 11 has the cross (+) shape illustrated in FIG. 1 and four square game sections are provided. However, other crosspiece shapes can also be provided with a different number of radiating arms and consequently a different number of game sections provided between the arms. Also, even with a cross shaped (+) crosspiece, less than four game sections can be used. For example, a playing surface can be provided with the crosspiece 11 and two diagonally arranged game sections 21, as illustrated in FIG. 8. Three game sections 21 could also be used with crosspiece 11, if desired.

It is preferable to provide each of the game sections 21 with a shape which is readily insertable between adjacent arms of the crosspiece, no matter what the orientation of the game sections. This permits ready reorientation of the game board pieces during or before a game to alter the playing surface.

The game apparatus can also be configured with a single piece playing surface, with the crosspiece and game sections or just the game sections being connected as a unitary assembly, if desired. However, this will result in some loss in playing flexibility as the game sections will then no longer be removable and reinsertable to alter the playing surface as described above. Another variant is illustrated in FIG. 7 where the crosspiece is omitted and the playing surface formed by juxtaposed game sections 21. Although four juxtaposed game sections 21 are shown n FIG. 7, any number of game sections could be used.

As illustrated in FIGS. 1 and 2, each of the game sections 21 may be provided with five rows and five columns of regularly spaced playing piece movement areas with nine of these, respectively located at the first, third and fifth positions of each of the rows, being provided with channels 23 in which are inserted game pieces 25. Other numbers of playing piece movement areas and channels can also be provided as desired. The playing surface of the game apparatus as illustrated in FIG. 2 contains eleven rows and eleven columns of equally spaced playing piece movement areas with a total of thirty-six channels. A central piece movement area 19 is provided as a convenient starting location for all playing pieces of the game. To increase the difficulty of playing piece movement, this central movement area may be considered "out-of-bounds" once a game commences.

In another modified embodiment of the invention illustrated in FIGS. 5 and 6, each of the playing piece movement areas 17 may be provided in the form of circular areas as opposed to the square areas illustrated in FIGS. 1 and 2. Naturally, the channels 23 are likewise circular as are the game pieces 25 (FIG. 6). Since two planar surfaces are provided on the game pieces of FIG. 6, two different types of indicia can be provided, one on each surface, to permit the playing of two different types of games.

Use of the described game apparatus to play a game will now be described.

A word game will first be described in which each of the playing pieces 25 has on an upper surface 33 thereof a letter indicium. At the beginning of the game, the board is set up. For purposes of further description, it will be assumed the board arrangement of FIGS. 1 and 2, using a crosspiece and four game sections, is used. It should be understood, however, that any of the board arrangements described above could be used. Also, the game sections can be oriented in any direction desired.

After the board set up is completed, each of the game pieces 25 is randomly inserted into the channels 23 of each of the game sections 21. After all game pieces 25 are inserted into the channels 23, each of the players selects a letter pattern forming a word which can be created using the letters shown on the playing surface. A player will select a word containing up to a given number of letters, e.g., seven, which another player must spell by moving his playing piece among playing piece movement areas 17 to traverse all the letters of that selected word. A timer can be provided to establish a time period during which each player makes his word selections for another player. After the time period expires, the words selected by each player are then passed to another player, e.g. a player to the left, who must complete a path through all letters of the word. The game can be played such that each word must be spelled by traversing the letters of the word in sequence or randomly, as desired. Instead of each player selecting a word for another player, each player selected word can be written on a piece of paper, which is folded and placed at a central location from which each player may then blindly withdraw a piece of paper and an associated word for him to traverse. Also, the letters of the word can be furnished one at a time to a player as he traverses a previously furnished letter of his assigned word.

When moving a playing piece among the various playing piece movement areas 17, a playing piece must always move through all movement areas 17 of a group, defined by the plurality of first indicium 27, before proceeding to another group. Thus, for example, if a playing piece is in group 29 as illustrated in FIG. 2 it must traverse each of the three movement areas 17 of that group before it can move to another group. Moreover, a playing piece can only leave and enter a group at terminal movement areas of the group by moving only horizontally or vertically. The direction indicator 46 of each playing piece helps keep track of the direction in which a player is moving.

All players can conveniently start at a central playing piece movement area 19. To make the game more difficult, this playing piece movement area 19 can then thereafter be considered "out-of-bounds", that is, an area to which a playing piece cannot move once the game has started. This forces playing pieces to move around playing piece movement area 19, creating further difficulties in a player reaching all the letters of his assigned word.

Instead of commencing a game with all pieces at a central location, each player may be allowed to place a playing piece for another player at any movement area 17 desired. This will add additional difficulty in a player reaching all letters of an assigned word.

In traversing through the various playing piece movement areas 17, a playing piece may land on a message area, in which case the player is required to perform the function specified by the message. In the case of the message "turn board", a player is entitled to reorient one of the game sections 21 in any manner desired. This will reconfigure the relative locations of the various groups of movement areas of the rotated group piece 21 relative to the playing piece movement areas of the remainder of the board. This can be used to advantage in facilitating a player's movement to the letters required for his particular word, or to frustrate another player's attempts to reach his assigned letters. Other message areas, as shown in FIG. 2, could include "skip turn", "go again", and "exchange men", the latter enabling a player to exchange his playing piece with other playing pieces on the board.

The number of playing piece movements in a turn can be dictated by the toss of the dice, the spin of a dial, or each player may be assigned a particular predetermined number of "moves" from one movement area to another during a particular turn. Players may also be required, if desired, to move in a forward direction within each group with only one "back-up" movement per turn being allowed.

Since there are no groupings of movement areas 17 on the crosspiece, a player can easily move his playing piece along the crosspiece arms between different game sections. Thus, further difficulty in movement of a playing piece between game sections 21 is encountered if crosspiece 11 is omitted and the playing surface formed solely by juxtaposed game sections 21.

As stated, the object of the game is to be the first player to complete the tortuous path required to reach, by landing on or passing, all the letters of the word assigned. The first player to reach all the assigned letters is the winner. The game can be played with each player required to reach his assigned letters in the order presented in the word or in random order.

As described above, the game apparatus of the invention may also be used to define mathematical problems by assigning numbers to the indicium surface 33 of each of the playing pieces 25. These numbers and also optionally mathematical operators such as addition, substraction, multiplication, division and equals symbols are thus randomly scattered over the playing surface in the same manner as the letters previously described. Each player is then given a predetermined period of time, again as determined by a timer, to select a mathematical problem involving, for example, two or three digit numbers which must be completed by a playing piece reaching each of the numerals of the problem. For example, a player may select the problem $12\times23=276$ in which case an opposing player would have to reach the numerals and symbols 1, 2, $\times$, 2, 3, $=$, 2, 7, and 6 to complete his problem. Or, a number may be selected for a player to traverse, e.g. 752,476. Other than changing the letters to numerals and symbols (if used), the remainder of play of this game would proceed as described above for the word game.

Other game variants will occur with use of other indicia on the top surface 33 of game pieces 25. For example, a player may be required to traverse a pattern consisting of different card symbols, different states, different countries, or different inventions. The game pieces shown in FIGS. 7 and 8 containing different ones of these indicia on respective surfaces could thus be used to create six different game variants. For playing a game involving inventions, the indicium on upper surface 33 of a game piece would correspond to different inventions of a predetermined number of inventors. For example, with the game board illustrated in FIGS. 1 and 2 containing thirty-six channels, thirty-six inventions corresponding, to e.g. six, inventors could be used. A player may be assigned an inventor and to win must be the first to traverse all of the inventions associated with his assigned inventor. A variant of this would be to assign each player a pattern to traverse consisting of one invention of each inventor, or to require each player to traverse all inventions of a particular inventor in the chronological order invented.

If playing card symbols are used, as the indicium on game pieces 25, some of the card symbols may be provided on the non-channel playing piece movement areas of the board so that all fifty-two cards in a deck can be displayed. Likewise, for states and countries, non-channel playing piece movement areas can be provided with state and country indicium in addition to the upper face 33 of the game pieces 25.

To further complicate play, several different colors could be used for the movement areas 17. During a turn, if a player lands on a particular color and other players are on the same color, the player landing on the color can re-place the playing pieces of the other players on the same color at any movement area 17 desired. Also, provisions may be made for changing the remainder of a player's assigned pattern during the course of play. For example, during a word game, a player may be provided the opportunity to assign a different word to another player containing the same letters already traversed by that other player and other letters different from those contained in the word originally assigned.

While particular embodiments of the invention have been shown and described as above, it is apparent that numerous modifications can be made without departing from the spirit and scope of the invention. For example, both sides of the game sections and crosspiece (if used) could be provided with the playing piece movement areas and grouping indicium, thus providing use of two different sides of each the game sections and crosspiece. Accordingly, it is to be understood that the above description is merely for explanation purposes only and is not limiting of the invention, the invention being limited solely by the claims which are appended hereto.

What is claimed is:

1. A game apparatus comprising:

a game board including, on a top surface thereof, a plurality of playing piece movement areas, at least some of said playing piece movement areas being included in an area defined by a channel extending vertically through said game board, each of said channels being adapted to receive a respective game piece, at least some of said playing piece movement areas being grouped into a plurality of playing piece movement area groups by a plurality of first indicium which identify each said group by interconnecting playing piece movement areas within each said group, each of said groups being separate from each of said other groups by the absence of any indicia interconnecting said groups; and, a plurality of game pieces adapted to respectively fit into said channels, each of said game pieces having on at least an upper face thereof a respective second indicium which, with second indicium from others of said game pieces, defines indicia patterns to be traversed by a movable playing piece moving among said playing piece movement areas.

2. A game apparatus as in claim 1 wherein said playing piece movement areas and first indicium are provided on both sides of said game board.

3. A game apparatus as in claim 1 wherein said playing piece movement areas and channels are round and said game pieces have a cylindrical configuration with opposing planar ends.

4. A game apparatus as in claim 3 wherein said game pieces are provided with two different types of second indicium on said opposing planar ends.

5. A game apparatus as in claim 1 wherein said second indicium are letters of the alphabet.

6. A game apparatus as in claim 1 wherein said second indicium are numbers.

7. A game apparatus as in claim 1 wherein said second indicium are playing card symbols.

8. A game apparatus as in claim 1 wherein said second indicium are names of states.

9. A game apparatus as in claim 1 wherein said second indicium are names of countries.

10. A game apparatus as in claim 1 wherein said second indicium are names of inventions.

11. A game apparatus as in claim 1 wherein said playing piece movement areas and channels are square and said game pieces have a square configuration.

12. A game apparatus as in claim 11 wherein said game pieces are cubic and six different types of second indicium are respectively provided on the six faces thereof.

13. A game apparatus as in claim 1 wherein said second indicium are provided on non-channel movement areas of said game board as well as on the upper face of said game pieces.

14. A game apparatus as in claim 1 wherein said game board comprises at least two game board sections juxtaposed to one another, said channels being provided in said game board sections.

15. A game apparatus as in claim 1 wherein said game board comprises:

a center game board crosspiece including a center portion and a plurality of arms extending outwardly from said center portion, each of said arms having a portion of said playing piece movement areas extending along a top surface thereof; and at least two game board sections, each adapted to interchangeably fit between two adjacent arms of said crosspiece, each of said game board sections including, on a top surface thereof, another portion of said playing piece movement areas, said channels being provided in said game board sections, said playing piece movement areas in each said game board section being grouped into a plurality of playing piece movement area groups by said plurality of first indicium.

16. A game apparatus as in claim 15 wherein the arms of said crosspiece have sides containing game board section holding elements and each of said game board sections has sides containing a complementary holding element for engaging with a holding element at the side of an arm of said crosspiece.

17. A game apparatus as in claim 16 wherein each said holding element is a magnet and each said complementary holding element is a metallic element.

18. A game apparatus as in claim 15 wherein said crosspiece has a cross shape and four said game board sections are provided, each adapted to fit between two adjacent arms of said crosspiece.

19. A game apparatus as in claim 18 wherein said crosspiece and game board sections fit together to form a square game board.

20. A game apparatus as in claim 19 wherein each said game board section is square.

21. A game apparatus as in claims 14 or 15 wherein each said game board section is adapted to fit relative to at least another of said game board sections in a plurality of different orientations.

22. A game apparatus as in claims 14 or 15 wherein each game board section includes an equal number of rows and columns of playing piece movement areas.

23. A game apparatus as in claim 22 wherein each said game board section includes twenty-five playing piece movement areas, arranged in five rows and five columns, and nine of said movement areas are included in areas defined by channels.

24. A game apparatus as in claim 23 wherein said nine channels are provided on each game board section at the movement areas located at the intersections with the first, third and fifth columns.

25. A game apparatus as in claims 14 or 15 wherein at least one of said playing piece movement areas contains player instruction messages.

26. A game apparatus as in claim 25 wherein said instruction messages include at least one of the instructions to rotate one of said game board sections, skip a turn, exchange playing pieces, and take an additional turn.

* * * * *